US006347423B1

(12) United States Patent
Stumpf

(10) Patent No.: US 6,347,423 B1
(45) Date of Patent: Feb. 19, 2002

(54) JACKETED CUSHIONING ELEMENTS AND ASSEMBLIES THEREOF IN MATTRESSES AND UPHOLSTERY

(75) Inventor: Walter Stumpf, Dunwoody, GA (US)

(73) Assignee: Sidhil Technology, LLC, Chamblee, GA (US)

( * ) Notice: Subject to any disclaimer, the term of this patent is extended or adjusted under 35 U.S.C. 154(b) by 0 days.

(21) Appl. No.: 09/675,788

(22) Filed: Sep. 29, 2000

(51) Int. Cl.[7] ..... A47C 27/05
(52) U.S. Cl. ..... 5/720; 5/719; 5/740; 5/655.9
(58) Field of Search ..... 5/719, 720, 655.8, 5/740, 655.9, 645, 718; 206/139, 150; 428/101

(56) References Cited

U.S. PATENT DOCUMENTS

| | | | | |
|---|---|---|---|---|
| 685,160 A | | 10/1901 | Marshall | |
| 2,446,775 A | | 8/1948 | Marsack | |
| 2,858,881 A | | 11/1958 | Newall et al. | |
| 3,401,411 A | | 9/1968 | Morrison | |
| 4,194,255 A | | 3/1980 | Poppe | |
| 4,485,506 A | * | 12/1984 | Stumpf et al. | 5/655.8 |
| 4,523,344 A | | 6/1985 | Stumpf et al. | |
| 5,079,787 A | | 1/1992 | Pollmann | |
| 5,222,264 A | * | 6/1993 | Morry | 5/718 |

* cited by examiner

*Primary Examiner*—Lynne H. Browne
*Assistant Examiner*—Fredrick Conley
(74) *Attorney, Agent, or Firm*—Fitch, Even, Tabin & Flannery

(57) ABSTRACT

The subject matter is a cushion core construction in which individual elements of cushion material in plug-like form are connected together in a string by capturing them between two strips of flexible sheet material which are joined together between adjacent elements to hold the elements in place. The preferred structural unit is a two-row module formed by joining two such strings at intervals of at least two elements to enable them to stand alone, and to facilitate their handling in their assembly with like modules to form a more extensive core.

19 Claims, 3 Drawing Sheets

22
60
66
62
64
68
24
24
70
70
74
22"
72
22'
20
28

74'
72'

20
26
28

28
22
24

24
26
20
22

22

22
30
32
7b
7b

32

34
22

36
22

JACKETED CUSHIONING ELEMENTS AND ASSEMBLIES THEREOF IN MATTRESSES AND UPHOLSTERY

BACKGROUND OF THE INVENTION

This invention relates to a series of jacketed individual bodies of homogeneous, resiliently compressible cushioning material joined together in a string adapted for use in various assemblies and orientations as the core cushioning material of mattresses, seat cushions, pillows, and upholstery.

Strings of pocketed wire springs have been employed for about a century in assemblies of such springs as cores for mattresses and cushions, beginning with the mattress construction patented by James Marshall in 1901, U.S. Pat. No. 685,160.

Similarly, chemistry has provided the bedding and furniture industry with foamed elastomeric material of a variety of kinds which have gained wide acceptance as cushioning materials, primarily in integral form as slabs or blocks when constituting the primary cushion core material, or in sheet form for use as padding on the faces or around the borders of assemblies of wire springs.

While some effort has been made to develop cushion cores from assemblies of individual elements of foamed elastomeric material, they have not come into widespread use, due perhaps to difficulty of manufacture. Examples are found in U.S. Pat. No. 2,858,881-Newall and U.S. Pat. No. 4,194,255-Poppe.

SUMMARY OF THE INVENTION

The present invention adapts the pocketed spring technology to the manufacture of strings of individually jacketed, discrete cushion elements of homogenous resiliently compressible material, which facilitates their use in various assembly combinations and orientations made available by the omnidirectional resilience of the material itself

DESCRIPTION OF THE DRAWINGS

The invention is described in reference to the accompanying drawings, in which:

FIGS. 7(*a*) and 7(*b*) are respectively isometric and cross-sectional views of a form of cushion element modified from cylindrical form to alter its resilience;

FIG. 8(*a*) is a cylindrical cushion element that is cored to modify its resilience as compared to d solidly cylindrical element, and FIG. 8(*b*) is a similarly cored cylindrical cushion element housing a wire coil compression spring;

DETAILED DESCRIPTION OF THE ILLUSTRATED EMBODIMENTS OF THE INVENTION

Figures 1, 2, 3, 4, 5, 6, 7A, 7B, 8A, 8B:
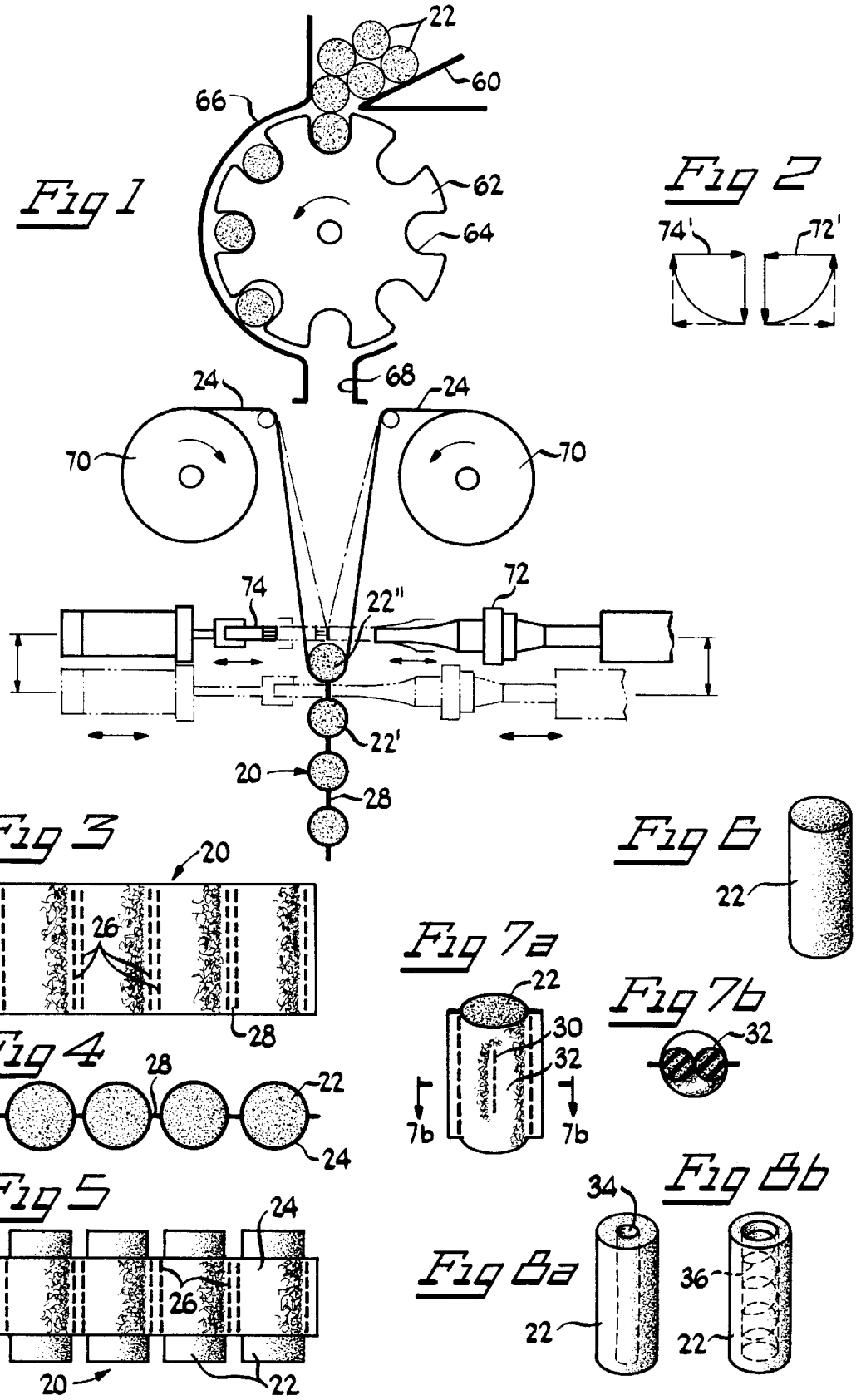
FIG. 1 is a schematic representation of an arrangement for selecting discrete cushion elements singly from a supply hopper for delivery between two fabric strips which are joined together before and behind each element to embrace the element.
FIG. 2 is a diagram of the motion pattern of the strip-joining mechanism.
FIG. 3 is an elevation of a connected series of jacketed cushion elements of cylindrical form produced by the apparatus of FIG. 1.
FIG. 4 is a top (or bottom) view of FIGS. 3 or 5.
FIG. 5 is an elevation of a modified form of the series of FIG. 3 wherein the individual cylindrical elements over-extend the jacketing fabric strip.
FIG. 6 is an isometric view of the cylindrical, plug-like cushion element of FIGS. 3 to 5.

Referring initially to FIGS. 3 and 5, the connected series or string 20 of jacketed cushion elements 22 comprise individual plug-like cylindrical bodies of resiliently compressible material embraced along their curved surfaces by a pair of strips 24 of sheet material joined together on diametrically opposite sides of the cylindrical bodies.

The resiliently compressible material of each cushion element 22 is preferably polyfoam, which may be a polyurethane resin blown with a suitable blowing agent and preferably having a predominantly open-celled structure. Alternatively, the material can be foam latex, sponge rubber, rubberized hair, or any of the resilient cushioning materials known which are generally homogenous in character and which are essentially omnidirectionally resilient.

The strips 24 of sheet material which jacket the individual plug-like cushion elements 22 are preferably a weldable, fibrous thermoplastic material for strength, economy of manufacture, and ease of manufacturing control. Such a material lends itself to being joined or seamed by ultrasonic welding, thus avoiding the need for adhesives to join the opposing strips 24 of sheet material before and behind each element 22.

I perceive that other sheet materials may also be used, for example, those of predominantly natural fibers blended with a sufficiently high thermoplastic content to be weldable, or even a thermoplastic film material if capable of exerting an adequate grasp upon the individual cushion element 22 to prevent displacement of the cushion element axially from its surrounding jacket, which is preferably left open at both ends.

While it would be less desirable as overly labor-intensive, it would also be possible to use a textile fabric of entirely natural fibers, e.g., cotton or linen, cross-seamed at predetermined intervals by sewing, and later filled by inserting the individual cushion elements 22.

Figure 9:
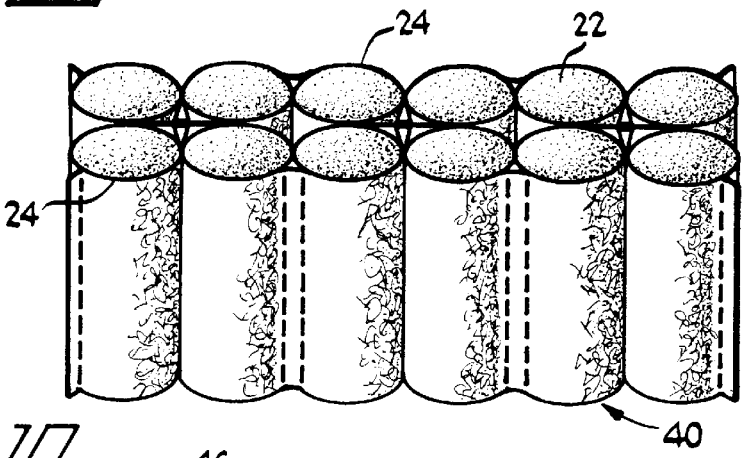
FIG. 9 shows a two-row cushion core module preferred as the basic construction element of a cushion- or mattress-core assembly.

In the cross-seaming joinder of the two strips 24 of sheeting, I prefer a double line of connection, i.e., welds 26, of the strips 24 together between successive individual cushion elements 22 of the string. Lines of welded connection should be lines of intermittent welds 26 for preservation of the tensile strength of the strips 24 and to facilitate the control of the weld. Between successive cushion elements, the lines of welds and the strip material between them form a hinge 28, which need not be long but preferably sufficient to allow some freedom of deflection of the individual cushion elements when joined to form the two-row module of FIG. 9, still to be described.

Dimensionally, I have found it very satisfactory to use cylindrical cushion elements having a height to diameter ratio of 2 at a height of 5 inches. Using 5-inch wide strips of needled and calendared polypropylene fiber sheeting, I provide a hinge section 28 one-quarter inch long throughout the width of the strip by welding the two opposed strips together with two lines of intermittent welds each ⅜" long and 1/16" wide spaced ¼" apart within each line of welds, and with a space of ⅛" between the two lines.

The cylindrical cushion elements 22, for example, if of polyurethane foam, may have a density within the customary range, depending upon the firmness of the "feel" desired in the mattress or cushion using the illustrated cushion core construction. The elements 22 may be die-cut or trepanned from a slab of foam of the desired thickness, but are preferably either molded individually in cylindrical form and trimmed to desired height, or continuously extruded and cut to length.

While the firmness or softness of the cushion is readily varied by selection of the appropriate density of the foamed cushioning material of the individual cushion elements, further modification of resiliency of the cylindrical form at any density is possible. For example, the tautness of the wrap of the strips 24 about the cylindrical elements will vary the resulting "feel", which will be firmed by increased wrap tension, effecting pre-compression of the cushioning material. More elaborately, referring to FIGS. 7(*a*) and 7(*b*), the jacketed element 22, being thermoplastic and surrounded by a thermally weldable fabric, may be stiffened by a radial penetration of ultrasonic welding units from both sides to join the jacket strips to the polyurethane core in a rigid weld 30 of solid material between two partially compressed columns 32 at mid-height of the element 22. The weld 30, if linear, may be varied in length to vary the stiffening effect. Other weld forms will suggest themselves.

A softening of the cushion element 22, on the other hand, may be achieved by coring the element as shown at 34 in FIG. 8(*a*), or a further stiffening by inserting into the cored element a wire coil spring, as at 36 in FIG. 8(*b*).

To prepare the strings of cushion elements 22 for practical use, they can be joined, row upon row, with cushion elements upstanding in mattress or cushion-size assemblies, by the use of adhesives, for example of the hot melt variety, or by welding of the jacketing strip material of adjacent rows at the hinge sections 28 between cushion elements, displacing the weld by one cushion element between successive rows, as in my prior U.S. Pat. No. 4,451,946.

For practical purposes, however, I prefer the two-row module 40 for its versatility, and prefer to fabricate it by connecting two rows of the jacketed cushion elements together at every other hinge section between elements. A hot-melt adhesive may be used for the purpose, but a simple spot weld at mid-length of the hinge connection 28 will suffice and is preferred. The two-row module is likewise fabricated as a continuous chain, using an insertable ultrasonic probe and anvil similar to that yet to be described for making the jacketed elements in connected series or "strings".

The two-row chain is severed into modules 40 of length appropriate to the intended use by simply cutting through the hinge connections 28 between corresponding successive cushion elements of the two rows. The preferred double line of welds 26 between successive cushion elements 22 preserves one line of welds on both sides of the shearing cut, and thus the integrity of the jackets adjacent to the separating cut.

Figure 10:
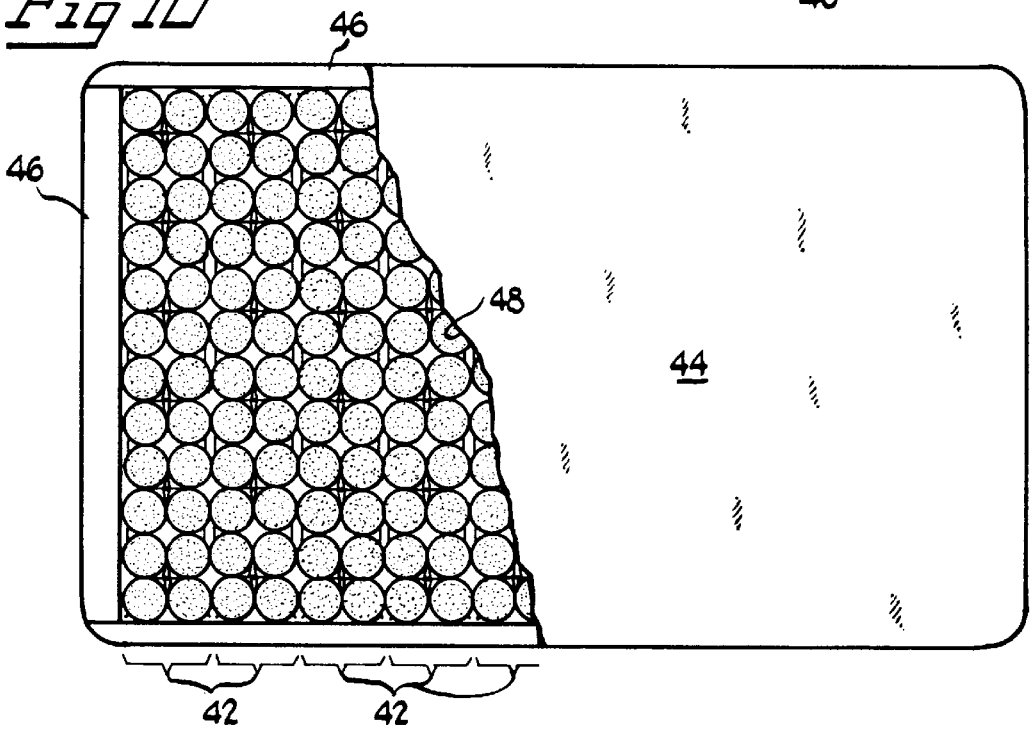
FIG. 10 is a fragmentary plan view, partially broken away, of a mattress showing two-row modules like those of FIG. 9, each of mattress width in length and laid alongside each other transversely of the mattress to be surrounded by a cushion border to which a top cushion layer is secured.

FIG. 10 illustrates the utilization of two-row modules 42 of jacketed cushion elements of length corresponding to the width of the mattress 44, and with the axes of the cushion elements 22 vertical when the mattress is horizontal, as on a bed. The modules 42 are encased, side by side, within a polyfoam border 46 which is secured to an underlying foam sheet and closed by a top sheet 48 also of polyfoam adhered to the border 46, and if desired, to one or more of the modules 42. This arrangement lends itself to a gradation of firmness, module by module, or by multi-modular zone, along the length of the mattress, i.e., from head to foot.

Figure 11:
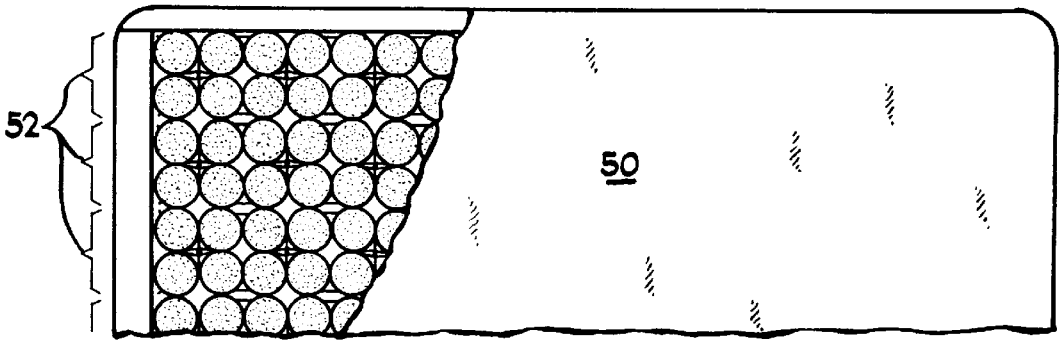
FIG. 11 is a fragmentary plan view of a mattress similar to FIG. 10 but in which the two-row modules are made in full mattress length and extend the long direction of the mattress.

FIG. 11 illustrates an alternate mattress configuration 50 in which two-row modules 52 run lengthwise of the mattress, being of mattress length, and the individual cushion elements are axially vertical. This arrangement lends itself to a double bed or larger mattress that may be fitted out to suit the differing cushioning preferences of the two occupants of the bed.

Figure 12:
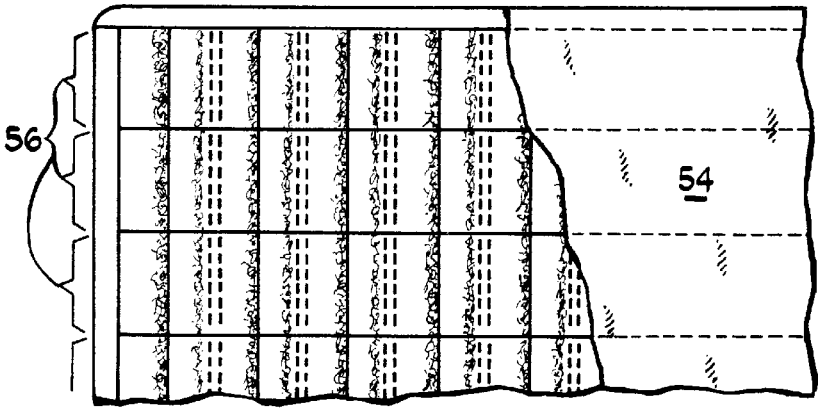
FIG. 12 is a fragmentary plan view, partially broken away, of a mattress similar to that of FIG. 11 in that the modules run the long way of the mattress, but differing in that the modules lie on their sides so as to receive the body weight reposed upon the mattress in a generally radial direction relative to the cylindrical cushion elements.
Figure 13:
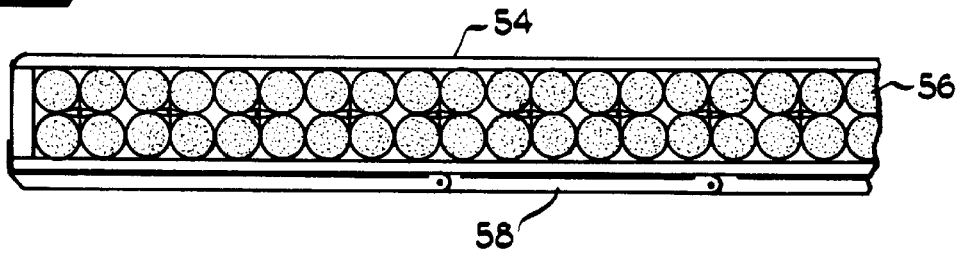
FIG. 13 is a fragmentary cross-sectional elevation of the mattress of FIG. 12, reposed on the sectional bed bottom of a hospital bed, or so-called adjustable bed.
Figure 14:
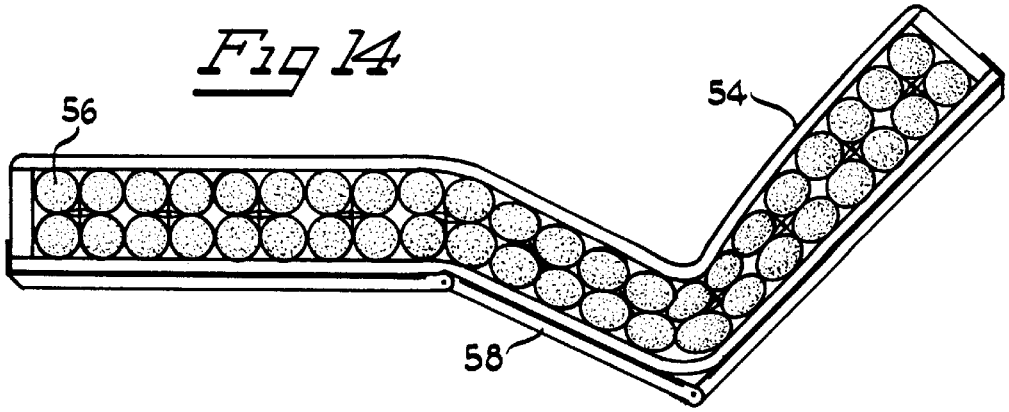
FIG. 14 is a cross-sectional elevation of the mattress of FIGS. 12 and 13, shown full length with the bed bottom in a reclined sitting position.

The mattress 54 of FIGS. 12 to 14 inclusive demonstrates the versatility of the omnidirectionally resilient cushion elements of the invention, for, in contradistinction to the more conventional, axially-vertical cushion-element orientations of FIGS. 10 and 11, the cushion elements 22, again preferably in two-row modules 56, are laid on their sides in the long direction of the mattress. The number of modules laid side-by-side will depend upon the width of the mattress, which, in this configuration, is especially adapted for mattresses which are required to flex, i.e., those designed for hospital beds and for so-called Adjustable Beds for home use. Conventional one-piece innerspring mattresses tend to separate from the supporting bed bottom 58 because their stiffness does not allow them to conform to the articulated bed bottom when the several sections are adjusted out of supine alignment.

In the mattress of FIGS. 12 to 14, on the other hand, the orientation of the hinged cushion elements 22 in the modules 56 permits them to flex readily, and enables the mattress 54 so equipped to conform to the shape assumed by the supporting bed bottom 58.

Whether the two-row modules are positioned with the individual cushion elements 22 upright in the mattress, as in those of FIGS. 10 and 11, or with the elements 22 horizontal, as in the more flexible mattress of FIGS. 12 to 14, the two-row module maintains the relationship of the individual elements to each other in a basically four-element or quadratic array. This array preserves the interstices inherent in the tangential contact of the curved surfaces of the individual elements. In the assembled mattress, these interstices provide air circulation passages which are beneficial irrespective of the cushioning material employed but particularly so for constructions which employ foam latex, whose cellular structure does not "breathe", and which otherwise might exhibit the "clamminess" that some find objectionable in integral mattress cores of foamed latex as such.

FIG. 1 depicts schematically my presently preferred arrangement of apparatus for the manufacture of the connected strings of jacketed cushion elements. It includes an upper hopper 60 containing a supply of cushion elements 22 which are supplied by gravity to a feed drum 62 provided about its periphery with a plurality of pockets 64 sized to hold a single cushion element 22 with its axis parallel to the rotational axis of the drum.

Extending in the direction of rotation of the drum 62, beginning at the upper, element-receiving station and terminating at the lower delivery station, a sheet metal cover 66 conforms to the periphery of the drum 62 to maintain the cushion elements 22 in their pockets 64. At the bottom of the drum, the cover is extended downwardly, and with an opposing sheet metal wall 68, forms a chute to guide the cushion element 22 dropped from the lowermost drum pocket 64 into the convergence of two strips 24 of sheet material fed from supply rolls 70 on opposite sides of the descending path of the cushion element 22 falling from the drum.

The strips 24 of sheeting converge to their connection 26 with each other effected ultrasonically by an ultrasonic horn 72 poised on one side of the strips in opposition to a serrated anvil 74 mounted on the other side of the strips. Each is mounted for movement toward and away from contact with the other under the influence of appropriate compressed air drivers, and both are mounted for similarly powered vertical reciprocation in unison so as to index the string of jacketed cushion elements 22 downwardly after sealing each element into the strips by performing the ultrasonic weld above each new element dropped from the drum 62.

The pattern of movement of the ultrasonic horn and anvil members 72–74 is depicted by FIG. 2. With the sealing members 72–74 poised as in the solid line positions of FIG. 1, those members move into pressing contact with the sheeting strips 24, closing them about the then uppermost cushion element 22' and welding them together by the application of ultrasonic energy for the necessary brief time. Thereafter, but with the horn and anvil in tight engagement with what will become the hinge section 28 between the newly embraced cushion element and the next element 22" to fall, the horn and anvil descend in unison to advance the strip and to draw more strip material from the supply rolls 70. The horn 72 and anvil 74 then retract away from contact with the weld, and return upwardly to starting position for the initiation of another cycle. The latter movement may be a single combined movement along a curvilinear path, as indicated in solid line in FIG. 2, or separate sequential movements on rectilinear paths, as shown by broken lines.

The drum 62 is preferably driven intermittently by compressed air, for example, using a Bimba rotary actuator connected through a one-way clutch to drive an adjustable pulley connected by timing belt to a driven pulley on the shaft of the drum. The drive is not shown in FIG. 1, but its described components are conventional and readily available.

In the foregoing, I have described and shown my new cushioning elements united in string form by two facing strips of sheet material which encircle the individual elements in a frictional grasp, and as a two-row module preferred as the basic building block in the assembly of mattress and cushion cores. The omnidirectional resilience of the cushioning elements frees them from the limitations imposed upon innerspring mattress construction, allowing the lateral disposition of the individual elements which enhances longitudinal flexibility of a mattress and more faithful conformity to the articulated bed bottoms of hospital beds and the like.

The features of the invention believed new and patentable are set forth in the following claims.

What is claimed is:

1. A string of connected, individually jacketed resiliently compressible cushion elements comprising:

two strips of sheet material having therebetween a series of elongated bodies of a resiliently omnidirectionally compressible material;

said bodies being spaced apart along said strips with their lengths arrayed transversely of said strips;

said strips being joined together between successive bodies so as to embrace said bodies in holding engagement to secure said bodies between said strips.

2. The subject matter of claim 1, wherein the width of said strips equals the lengths of said bodies.

3. The subject matter of claim 1, wherein the width of said strips is less than the lengths of said bodies.

4. The subject matter of claim 1, wherein the resiliently compressible material is polyfoam.

5. The subject matter of claim 4, wherein said strips are weldable and the joinder of the strips between the bodies are welds.

6. The subject matter of claim 5, wherein the welds which join the strips are intermittent along a line transverse to said strips.

7. The subject matter of claim 5, wherein the polyfoam bodies are stiffened by compressing the bodies from opposite sides of the string into a narrow weld which also extends transversely of the strips, the stiffness of the jacketed cushion element being increased by said narrow weld and controllable by the length thereof.

8. A cushion module comprising at least two strings of jacketed cushion elements as defined by claim 5, wherein said two strings are joined together by a welded cross-connection of the strips of both strings at intervals of at least two bodies therealong.

9. The subject matter of claim 1, wherein the resiliently compressible material is foamed latex.

10. The subject matter of claim 4 or claim 9, wherein the elongated boded is cylindrical and is cored axially.

11. The subject matter of claim 4 or claim 9, wherein the elongated body is cylindrical, is cored axially, and houses a wire coil compression spring coaxially therewith.

12. A cushion module comprising at least two strings of jacketed cushion elements as defined by claim 1, wherein said two strings are joined together by cross-connection of the strips of both strings at intervals of at least two bodies therealong.

13. The subject matter of claim 1, wherein said bodies of resiliently compressible material are pre-compressed by the embrace of said strips to increase their resistance to compression.

14. A flexible rectangular mattress core comprising a plurality of cushion modules each comprising at least two strings of jacketed cushion elements defined by claim 1 joined together side-by-side by cross-connection of the strips of both strings at intervals of at least two bodies therealong, each module having a length substantially the width of the core and extending transversely thereof.

15. A mattress core according to claim 14 wherein the sheet material of the strips is weldable and the said joinder of said strings and their cross-connection to form said modules are effected by thermal welds.

16. A mattress core according to either claim 14 or claim 15 wherein the transverse direction of said strips is perpendicular to the plane of the mattress core laid flat.

17. A flexible rectangular mattress core comprising a plurality of cushion modules each comprising at least two strings of jacketed cushion elements defined by claim 1 joined together by cross-connection of the strips of both strings at intervals of at least two bodies therealong, said modules having the length of the mattress core and being oriented side by side in the long direction of the mattress.

18. The mattress core of claim 17 wherein the transverse direction of said strips is perpendicular to the plane of the mattress core laid flat.

19. The mattress core of claim 17 wherein the transverse direction of said strips is parallel to the plane of the mattress core laid flat.

* * * * *